United States Patent [19]

Hösel

[11] Patent Number: 4,536,852

[45] Date of Patent: Aug. 20, 1985

[54] METHOD AND APPARATUS FOR DETERMINING THE HEIGHT OF TEXTILE FIBER BALES

[75] Inventor: Fritz Hösel, Monchen-Gladbach, Fed. Rep. of Germany

[73] Assignee: Trützschler GmbH & Co. KG, Monchen-Gladbach, Fed. Rep. of Germany

[21] Appl. No.: 414,948

[22] Filed: Sep. 3, 1982

[30] Foreign Application Priority Data

Sep. 5, 1981 [DE] Fed. Rep. of Germany ..... 3135272

[51] Int. Cl.[3] ..... G06F 15/20; D01G 7/08

[52] U.S. Cl. ..... 364/562; 19/145.5; 364/575

[58] Field of Search ..... 19/145.5, 80 R; 364/560, 562, 563, 575; 377/24

[56] References Cited

U.S. PATENT DOCUMENTS 3,378,676 4/1968 Clement ..... 364/563 X 3,806,990 4/1974 Goldammer et al. ..... 19/145.5

3,936,665 2/1976 Donoghue ..... 364/563 X 4,297,766 11/1981 Trützschler ..... 19/145.5 X 4,382,316 5/1983 Goldammer et al. ..... 19/145.5 X

*Primary Examiner*—Edward J. Wise

*Attorney, Agent, or Firm*—Spencer & Frank

[57] ABSTRACT

In order to determine the height of textile fiber bales disposed in successive groups in the operative range of a bale opener which is arranged to move horizontally adjacent the bale groups, each bale group containing at least one bale of fibers of a selected type and the opener being provided with a detacher disposed above the bales, movable vertically toward the bales for opening the bales, and carrying a measuring device for measuring the height of each bale group, a plurality of measurements of the height of each bale group is effected at a succession of horizontally spaced measuring locations by advancing the bale opener horizontally after each measurement, and an average of the measurements made on each bale group is formed.

9 Claims, 5 Drawing Figures

2
4c
4a
5
4b
1
1a
3

5
2
4

4

3

METHOD AND APPARATUS FOR DETERMINING THE HEIGHT OF TEXTILE FIBER BALES

BACKGROUND OF THE INVENTION

The present invention relates to a method for determining the height of textile fiber bales wherein the detacher of a bale opener moves horizontally in succession over the bales of a group of bales and is lowered vertically in the direction toward the bale surface so as to measure the height of the bale in question and wherein an optical proximity switch, for example, is used as the measuring device, the invention also relating to an apparatus for implementing the method.

In a known machine for the automatic removal of material from bales and blending of different fiber types from different bales, e.g. the machine manufactured and sold under the trademark BLENDOMAT by Trützschler GmbH & Co., Monchengladbach, FRG, it is necessary, before the start of processing, to determine the heights of the individual bales and to feed the resulting height information to an evaluation circuit. This process is performed manually and is therefore subject to subjective influences on the part of the operating personnel. The percentage of each component, or fiber type, in a blended mixture is determined by the number of bales present of that particular fiber type. The height and density of the bales generally vary.

In order to program the desired blend, or mixture, the known BLENDOMAT control is operated manually. The detacher is moved over the highest bale of one type of fiber and is permitted to move downwardly. Once the normal operating height has been reached, an optical proximity switch, or sensor, is activated so that the downward movement is stopped. This height, i.e. the actual height of the detacher, is stored in the memory of the electronic control. Then, according to the required production run, the downward advance, or stroke increment, of the detacher per working cycle is determined. The height of the bale and the stroke increment determine the number of processing runs required to completely process the bales containing this type of fiber. This number is stored as well. Thus, a measurement is made for each bale. Then the detacher is moved to the highest bale of the next type of fiber. The electronic system also stores this value automatically, divides it by the previously determined number of processing runs and stores the required stroke increment for this bale or group of bales, which increment is smaller than that required for the bale or bales containing the first fiber type. The electronic system has a storage capacity for mixtures containing up to four components.

When the processing of all components has been programmed, the control is switched to automatic operation. Then, the detacher is lowered further automatically with each working cycle according to the rate of downward advance programmed for each component or fiber type. Thus, in the prior art process, the height of each bale is measured only once, thus leading to the possibility of certain inaccuracies resulting at least in part from irregularities of the bale surfaces. It is particularly annoying that each measuring location must be approached manually.

The above-described machine is described in greater detail in a brochure entitled "Blendomat BDT Programmable Bale Opener" by Trützschler GmbH & Co. Kommanditgesellschaft Textilmaschinenfabrik, D-4050 Mönchengladbach 3 (FRG).

SUMMARY OF THE INVENTION

It is an object of the present invention to provide a method and apparatus of the above-mentioned type which enhances the degree of accuracy of the height determination and which permits simplified operation.

The above and other objects are achieved, according to the invention, by a method and apparatus for determining the height of textile fiber bales disposed in successive groups in the operative range of a bale opener which is arranged to move horizontally adjacent the bale groups, each bale group containing at least one bale of fibers of a selected type and the opener being provided with a detacher disposed above the bales, movable vertically toward the bales for opening the bales, and carrying a measuring device for measuring the height of each bale group. According to the invention, a plurality of measurements of the height of each bale group at a succession of horizontally spaced measuring locations is effected by advancing the bale opener horizontally after each measurement, and an average of the measurements made on each bale group is formed.

Due to the fact that a plurality of height measurements are made on each individual bale and an average is formed, falsifications of the measured value for the bale height by inadvertent scanning of a hill or dale on the bale surface are prevented. The fact that after each individual measurement the arm carrying the measuring device automatically advances to the next measuring location by a defined distance has the advantage that the measuring process is made more uniform. This avoids the arbitrarinesses of manual setting, and the movement between measuring locations has the same path length each time. A particular advantage is that the arm need not contact the bale but moves over the bales at a defined height and that the response sensitivity of the measuring device can be set very easily.

Preferably, the measurements are made and the arm carrying the measuring device is advanced steadily, or continuously, i.e. not stepwise. Advisably, a new average if formed after each individual measurement.

The present invention also includes an advantageous apparatus for implementing the invention, wherein the measuring device is in communication with a calculating and storage unit which is capable of controlling the drives for the horizontal movement of the carriage for the vertical movement of the detacher and which is able to calculate and store the average of the height measurements.

The invention will be described in greater detail below with the aid of an embodiment that is illustrated in the drawings.

DESCRIPTION OF THE PREFERRED EMBODIMENTS

Figure 1:
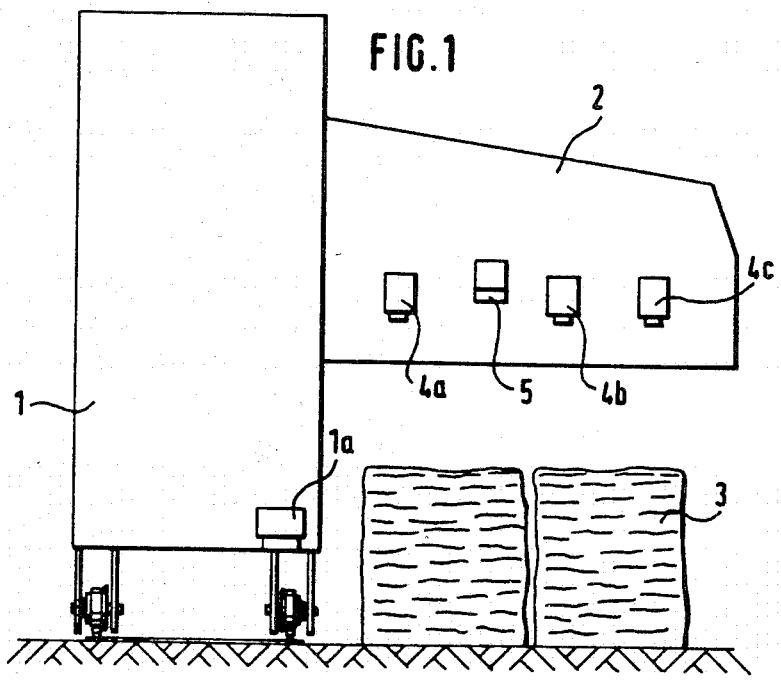
FIG. 1 is a simplified elevational view of a bale opener with measuring members conforming to the invention.
Figure 2:
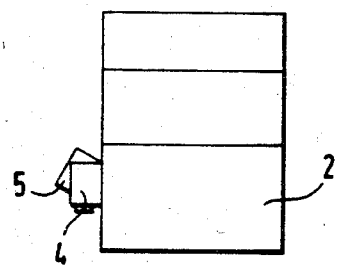
FIG. 2 is a side detail view of the detacher of the bale opener of FIG. 1.
Figure 3:
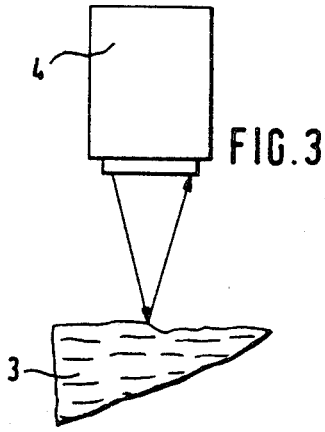
FIG. 3 is an elevational detail view of a measuring member positioned relative to the bale surface for implementing the invention.

FIG. 1 shows a bale opener such as the BLENDOMAT BDT including a turret 1 mounted on a truck which is movable horizontally on rails and which carries an arm 2 which projects laterally from the turret and is vertically adjustable with respect to fiber bales 3. Arm 2 houses a detacher which operates to remove a thin layer of fibers from each bale 3 positioned alongside the opener. A plurality of measuring members, or sensors, 4*a*, 4*b* and 4*c* are attached to one side face of the arm 2 and serve as scanning devices for measuring the height of the fibcr bale 3 disposed below them. Preferably, optical proximity detectors, or switches, are used as the measuring members. Additionally, a further measuring member 5 is provided to detect gaps between two fiber bales 3*a* and 3*b*, shown in FIG. 4, and this member 5 is positioned so that its sensing direction forms an angle with respect to the side face of arm 2, and with respect to the vertical, as shown in FIG. 2.

The arm 2 with the processing members of the detacher, e.g. a roller with toothed discs, is moved manually above the first bale 3 of the first component, or fiber type, the arm 2 then being at a predetermined height.

Figure 5:
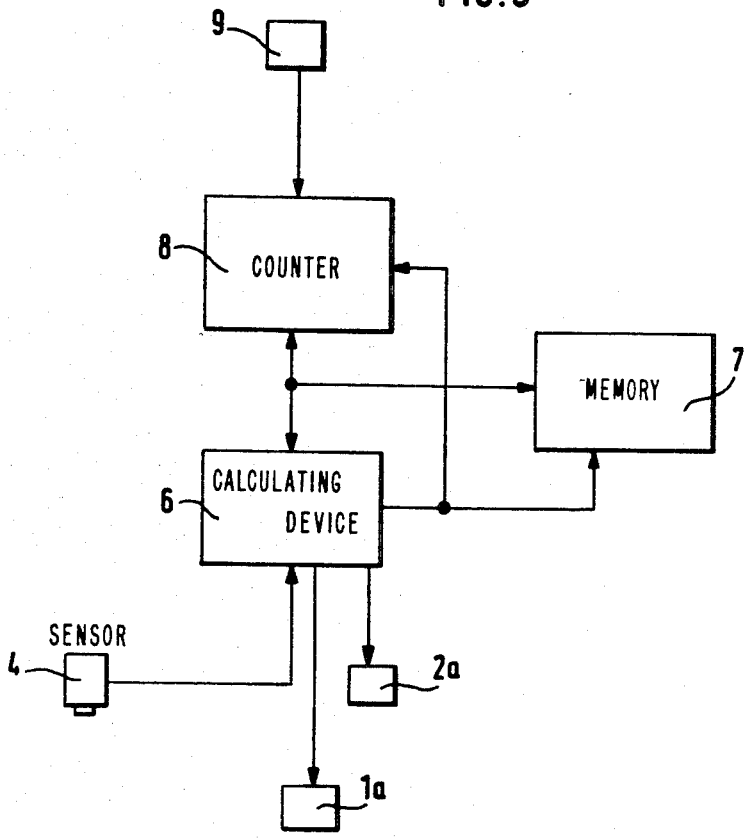
FIG. 5 is a schematic block diagram of a calculating and storage device for carrying out the invention.

Referring to FIGS. 1 and 5, a height measuring operation begins by actuating a start key to activate a pulse generator 9 to produce a train of pulses which are counted by a counter 8. Immediately after actuation of the start key, arm 2 begins to move downwardly at a selected speed. At the instant that a proximity sensing signal is first emitted by one of sensors 4*a*, 4*b* or 4*c*, i.e. by the first sensor to emit a signal, the count state of counter 8 is transferred into a memory 7 under control of a calculating device 6. Upon subsequent emission of a proximity sensing signal by each of the other sensors, the corresponding count state of counter 8 is transferred into memory 7. Once the last of sensors 4*a* through 4*c* has emitted its signal, the downward movement is stopped, turret 1 starts to move along its rails at a slow speed and the arm 2 is moved upwardly to the height at which a signal was first emitted by one of the sensors, plus a certain amount, e.g. 50 cm. Once arm 2 has arrived at that location, it is lowered again and the height determination is repeated as outlined above. For reasons of time efficiency turret 1 keeps moving during the entire measuring process. The vertical movements of arm 2 can be effected sufficiently rapidly to allow this to take place.

In the manner described above, a plurality of measured values are obtained from which an average bale height is formed in device 6, which is used for the further processing sequence. In order to save memory capacity, it is also possible to form an average immediately after each measurement. The computer 6, which is preliminarily provided with information regarding the number of sensors 4, then counts the number of measurements.

It is further possible, if there are extreme differences in height in the surfaces of bales 3 within one component, or consisting of one fiber type, to program the computer to process values other than the purely calculated amounts. For this purpose, a deviation with respect to the highest measurement may be given. This assures, for example, that the arm 2 will not be overly stressed by a particularly high bale 3. Such a fact can then be reported and the operator can be instructed to manually remove material from that bale 3. The end of a component, i.e. of bales containing one fiber type, is detected in the programming process, as in the known machine, by magnetic riders on the suction duct of the machine, a space of, for example, 1 m being provided between bales or groups of bales containing different fiber types. After determining the heights of all components, the carriage moves back to its starting position and begins processing the bales, i.e. detaching successive layers from all bales.

Figure 4:
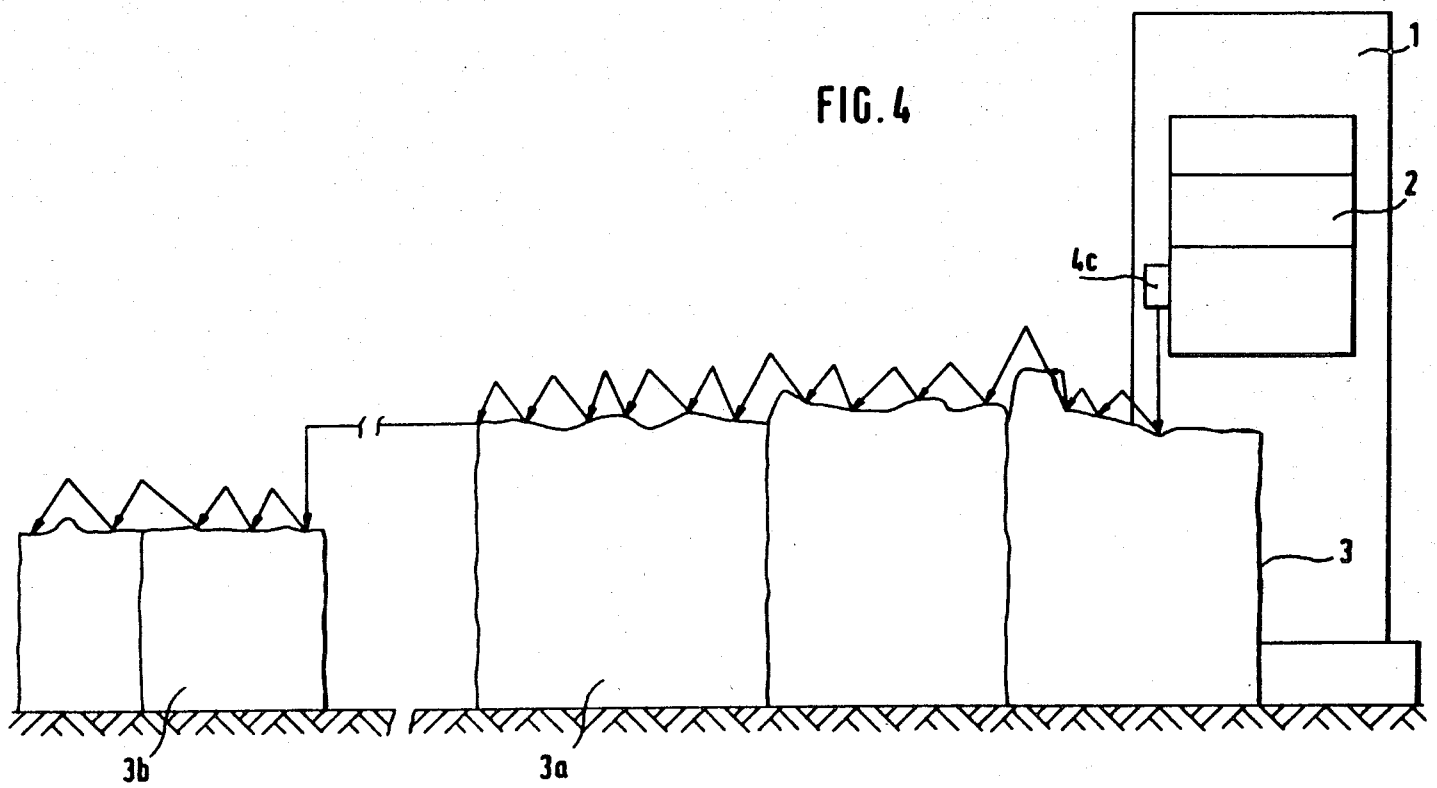
FIG. 4 is a schematic elevational yiew of a bale opener and a plurality of bales, illustrating the practice of the invention.

FIG. 4 is a schematic representation of the travel path of the measuring member 4*c*, and thus of arm 2, across the surface of several bales 3. Bale 3*a* and those to the right thereof contain fibers of one type; bale 3*b* and the bales to the left thereof contain fibers of a second type. The arm 2 moves vertically downwardly in the direction toward the surface of a bale 3 until the last of the sensors 4 responds, this being called the response height. This value is stored in memory 7. At the same time, the drive motor 1*a* of the turret is instructed to move the turret 1 with the arm 2 horizontally to the next measuring location, e.g. a distance of 50 mm. Moreover, the drive motor 2*a* of arm 2 is instructed to move vertically downward until it reaches the response height of this next measuring location. This value is likewise stored in memory 7. Further measurements are made in the same manner. A gap exists between the bales 3*a* and 3*b*, which is a component interface, which gap is sensed by sensor 5 and is traversed by a corresponding movement instruction to a drive motor 1*a* for the truck carrying turret 1.

As shown in FIG. 5, sensors 4 communicate with calculator device 6 which produces signals to control the operation of the drive motor 1*a* for the turret 1 and a drive motor 2*a* for the vertical movement of arm 2.

It will be understood that the above description of the present invention is susceptible to various modifications, changes and adaptations, and the same are intended to be comprehended within the meaning and range of equivalents of the appended claims.

What is claimed is:

1. Method for determining the height of textile fiber bales disposed in successive groups in the operative range of a bale opener which is arranged to move horizontally adjacent the bale groups, each bale group containing at least one bale of fibers of a selected type and the opener being provided with a detacher disposed above the bales, carrying a measuring device for measuring the height of each bale group, and movable vertically toward the bales for effecting such height measurement, comprising: effecting a plurality of measurements of the height of each bale of each group at a succession of horizontally spaced measuring locations by advancing the bale opener horizontally after each measurement; and forming an average of the measurements made on each bale group.

2. Method as defined in claim 1 wherein during said step of effecting a plurality of measurements, the bale opener is advanced horizontally in a continuous manner.

3. Method as defined in claim 2 wherein said step of forming an average is carried out after each measurement subsequent to the first.

4. Method as defined in claim 1 wherein the measuring locations are substantially equidistant from one another.

5. Apparatus associated with a bale opener for determining the height of textile fiber bales disposed in successive groups in the operative range of the bale opener, each bale group containing at least one bale of fibers of a selected type and the opener being provided with a detacher disposed above the bales, means for moving the detacher vertically toward the bales, and means for moving the opener horizontally adjacent the bale groups, said apparatus comprising: measuring means carried by the detacher for measuring the height of the bales; and a calculating and memory device connected to said measuring means and to the means for moving the detacher and the bale opener for causing said measuring means to effect a plurality of measurements of the height of each bale of each group at a succession of horizontally spaced measuring locations while advancing the bale opener horizontally after each measurement, and for forming an average of the measurements made on each bale group from the plurality of measurements effected by said measuring means.

6. Apparatus as defined in claim 5 wherein said measuring means comprise at least one measuring device in the form of an optical proximity switch.

7. Apparatus as defined in claim 5 or 6 wherein said measuring means comprise a plurality of measuring devices.

8. Apparatus as defined in claim 5 wherein said calculating and memory device comprises a counter communicating with said measuring means and a memory communicating with said counter.

9. Apparatus as defined in claim 8 wherein said calculating and memory device further comprises a pulse generator connected to supply counting pulses to said counter during each movement of the detacher toward the bales.

* * * * *